US008319162B2

(12) United States Patent
Mccool

(10) Patent No.: US 8,319,162 B2
(45) Date of Patent: Nov. 27, 2012

(54) STEERABLE SPIN-STABILIZED PROJECTILE AND METHOD

(75) Inventor: James W. Mccool, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 783 days.

(21) Appl. No.: 12/329,699

(22) Filed: Dec. 8, 2008

(65) Prior Publication Data

US 2012/0211590 A1 Aug. 23, 2012

(51) Int. Cl.
*B64C 17/06* (2006.01)

(52) U.S. Cl. ..... 244/3.1

(58) Field of Classification Search ..... 244/3.21, 244/3.23, 3.26, 3.28, 69, 12.2, 23 C, 3.1; 102/518

See application file for complete search history.

(56) References Cited

U.S. PATENT DOCUMENTS

| | | | | | |
|---|---|---|---|---|---|
| 2,183,314 | A | * | 12/1939 | Goddard | 244/79 |
| 2,822,755 | A | * | 2/1958 | Edwards et al. | 244/3.22 |
| 2,945,643 | A | * | 7/1960 | Slater | 244/3.2 |
| 3,485,173 | A | * | 12/1969 | Morgan | 102/518 |
| 3,588,003 | A | | 6/1971 | Johnston | |
| 3,767,139 | A | * | 10/1973 | Fischell | 244/165 |
| 3,977,629 | A | | 8/1976 | Tubeuf | |
| 4,288,051 | A | * | 9/1981 | Goschel | 244/164 |
| 4,431,147 | A | | 2/1984 | Paley | |
| 4,431,150 | A | * | 2/1984 | Epperson, Jr. | 244/3.21 |
| 4,441,670 | A | | 4/1984 | Crepin | |
| 4,568,039 | A | | 2/1986 | Smith et al. | |
| 4,728,057 | A | | 3/1988 | Dunne | |
| 4,738,411 | A | | 4/1988 | Ahlstrom et al. | |
| 4,754,707 | A | | 7/1988 | Ahlers | |
| 4,763,857 | A | | 8/1988 | Booth et al. | |
| 4,852,827 | A | | 8/1989 | Kranz | |

(Continued)

FOREIGN PATENT DOCUMENTS

WO 9823914 A2 6/1998

(Continued)

OTHER PUBLICATIONS

Rogers, Jonathan et al., "Control Authority of a Projectile Equipped with a Controllable Internal Translating Mass", Journal of Guidance, Control, and Dynamics, (2008), vol. 31, No. 5, pp. 1323-1333.

(Continued)

*Primary Examiner* — Michael Carone
*Assistant Examiner* — Reginald Tillman, Jr.
(74) *Attorney, Agent, or Firm* — Renner, Otto, Boisselle & Sklar, LLP

(57) ABSTRACT

A spin-stabilized projectile has its course controlled by counter rotation of an internal mass about a longitudinal axis of the projectile. The internal mass may be a boom within a cavity of an external body of the projectile. The internal mass may be tiltable relative to the hull, and may be configured to counter rotate relative to the hull about the axis of the hull. The counter-rotation may keep the boom in a substantially same orientation relative to the (non-spinning) environment outside of the projectile. The positioning of the boom or other weight within the projectile thus may be used to steer the projectile, by providing an angle of attack to the projectile hull. A magnetic system may be used to counter rotate the boom or other weight. The projectile may have a laser guidance system to aid in steering the projectile toward a desired aim point.

19 Claims, 6 Drawing Sheets

U.S. PATENT DOCUMENTS

| | | | | | |
|---|---|---|---|---|---|
| 4,883,239 | A | | 11/1989 | Lachmann et al. | |
| 4,903,917 | A | | 2/1990 | Peller et al. | |
| 4,951,901 | A | | 8/1990 | Dunne | |
| 4,966,078 | A | | 10/1990 | Schleimann-Jensen | |
| 5,085,380 | A | | 2/1992 | Barton | |
| 5,238,204 | A | | 8/1993 | Metz | |
| 5,315,158 | A | * | 5/1994 | Danielson | 290/1 R |
| 5,476,239 | A | * | 12/1995 | Brainard | 244/171 |
| 5,529,262 | A | | 6/1996 | Horwath | |
| 5,669,581 | A | | 9/1997 | Ringer | |
| 5,685,504 | A | | 11/1997 | Schneider et al. | |
| 5,775,636 | A | | 7/1998 | Vig et al. | |
| 5,788,178 | A | | 8/1998 | Barrett, Jr. | |
| 6,135,387 | A | | 10/2000 | Seidel et al. | |
| 6,360,987 | B1 | | 3/2002 | Sallaee et al. | |
| 6,422,507 | B1 | | 7/2002 | Lipeles | |
| 6,454,218 | B1 | * | 9/2002 | Jacobson | 244/165 |
| 6,474,593 | B1 | | 11/2002 | Lipeles et al. | |
| 6,745,980 | B2 | * | 6/2004 | Neff | 244/62 |
| 6,848,648 | B2 | | 2/2005 | Klestadt et al. | |
| 6,883,747 | B2 | | 4/2005 | Ratkovic et al. | |
| 7,036,767 | B2 | | 5/2006 | Chishinski | |
| 7,105,790 | B2 | | 9/2006 | Lamorlette | |
| 7,185,848 | B2 | * | 3/2007 | Heaven et al. | 244/93 |

FOREIGN PATENT DOCUMENTS

| | | |
|---|---|---|
| WO | 0214781 A1 | 2/2002 |

OTHER PUBLICATIONS

International Search Report and Written Opinion from corresponding International Application No. PCT/US09/57410.

* cited by examiner

STEERABLE SPIN-STABILIZED PROJECTILE AND METHOD

BACKGROUND OF THE INVENTION

1. Field of the Invention

The invention is in the field of spin-stabilized projectiles.

2. Description of the Related Art

Guidance systems for projectiles are often expensive and complex, as well as prone to damage to during launch or flight. There is a general need for improvements in guidance systems for projectiles.

SUMMARY OF THE INVENTION

In particular it would be desirable to produce guidance systems for spin-stabilized projectiles, such as munitions, that would be inexpensive, simple, robust, and that would allow control without deploying fins or other parts in the airstream, and without firing of rockets or other thrust-producing devices. It will be appreciated that control surfaces and thrust-producing devices are problematic to use in spin-stabilized projectiles.

According to an aspect of the invention, a projectile, such as a spin-stabilized projectile, uses inertial properties for steering. The inertial steering may involve movement (such as tilting) of an internal mass that is in a cavity in a body or hull of the projectile.

According to another aspect of the invention, a projectile, such as a spin-stabilized projectile, has an internal mass in a cavity of its hull, with the internal mass counter-rotating relative to hull in the direction opposite to the spin of the projectile.

According to yet another aspect of the invention, a projectile, such as a spin-stabilized projectile, has electromagnets on an inner surface of a hull, wherein voltage is selectively applied to the electromagnets to tilt and/or rotate a mass within a cavity in the hull.

According to still another aspect of the invention, a spin-stabilized projectile includes: an external body; and an internal mass in a cavity of the body. The internal mass is mechanically coupled to the hull such that at least part of the internal mass is selectively movable away from an axis of the body and rotated about the axis relative to the hull.

According to a further aspect of the invention, a method of controlling flight of a projectile includes the steps of: rotating in a first direction a hull of the projectile about a longitudinal axis of the projectile; and counter-rotating an internal mass of the projectile about the longitudinal axis in a second direction, opposite the first direction, relative to the hull of the projectile. The internal mass is within a cavity in the hull.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A spin-stabilized projectile has its course controlled by counter rotation of an internal mass about a longitudinal axis of the projectile. The internal mass may be a boom within a cavity of an external body of the projectile. The internal mass may be tiltable relative to the hull, or otherwise able to be shifted off the axis of the hull. The internal mass may be configured to counter rotate relative to the hull about the axis of the hull, rotating relative to the hull in a direction opposite to the spin direction of the hull. The counter-rotation may keep the boom in a substantially same orientation relative to the (non-spinning) environment outside of the projectile. The positioning of the boom or other weight within the projectile thus may be used to steer the projectile, by providing an angle of attack to the projectile hull. A magnetic system may be used to counter rotate the boom or other weight. The projectile may have a laser guidance system to aid in aiming the projectile and steering the projectile toward a desired aim point.

Figure 1:
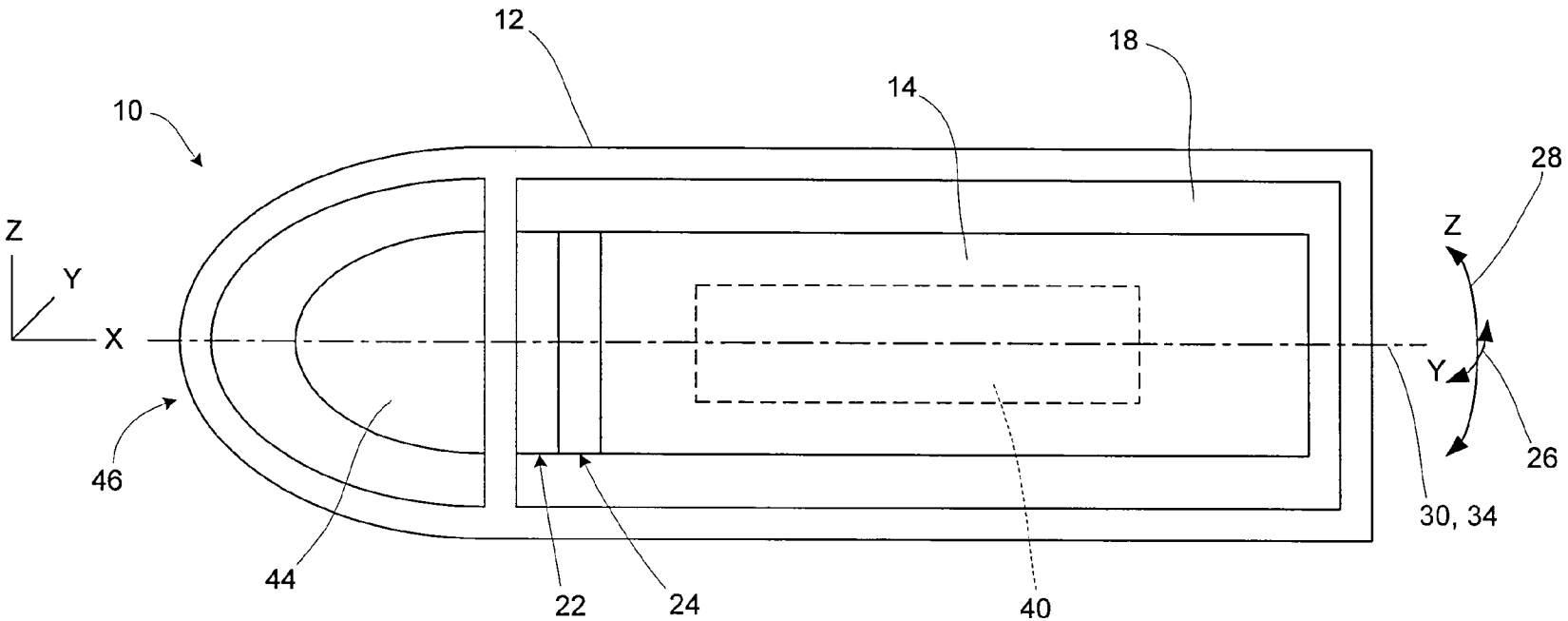
FIG. 1 is a cross-sectional view of a projectile in accordance with an embodiment of the invention.

FIG. 1 shows a spin-stabilized projectile 10 that is steerable by moving a weight within a hull or external body 12 of the projectile 10. The weight may be part of a boom or internal mass 14 that is located in a cavity 18 in the hull 12. The boom 14 is coupled to a pair of actuators, a y-axis actuator 22 and a z-axis actuator 24. The actuators 22 and 24 are used to tilt the boom 14 in respective y- and z-directions 26 and 28, relative to the hull 12 and other parts of the projectile 10. As described in greater detail below, the actuators 22 and 24 not only tilt the boom 14, pivoting at least one end of the boom 14 off of an axis 30 of the hull 12 and other parts of the projectile 10. The actuators 22 and 24 may also counter rotate the boom 14 relative to the hull 12 in a direction opposite to the spin direction of the projectile 10. This counter-rotation is a rotation of the boom 14 about the hull axis 30, as opposed to a rotation of the boom 14 about the boom axis 34. The counter-rotation may be at substantially the same rate as the spinning of the other parts of the projectile 10, such that the boom 14 is maintained in substantially the same orientation relative to the environment external to the projectile 10, in order to steer the projectile 10 in a given direction.

The actuators 22 and 24 may take any of a wide variety of forms, only some of which are discussed below. In some sense the depiction of the actuators 22 and 24 may be considered schematic, in that the actuators 22 and 24 may merely be separate aspects or characteristics of a single unified device. In addition, it will be appreciated that the mechanism represented by the actuators 22 and 24, used for tilting and counter rotating the boom 14, may be located elsewhere within the hull 12.

The boom 14 may constitute about half of the weight of the projectile 10, for example being from 49% to 51% of the weight of the projectile 10, or more broadly from 45% to 55% of the weight of the projectile 10. Balancing the weights of the boom 14 and the rest of the projectile 10 may simplify control of the flight of the projectile 10. However it will be appreciated that alternatively the boom 14 may be considerably less than half the weight of the projectile 10, for example being about 20% of the weight of the projectile 10. The boom 14 may contain a battery 40 that is used to power the actuators 22 and 24, as well as other systems of the projectile 10. Alternatively or in addition the boom 14 or other internal mass may include lead or another heavy material.

The projectile 10 may have guidance electronics 44 in a nose 46 of the projectile 10. The electronics 44 may be used to control the actuators 22 and 24, controlling the tilt and/or counter rotation of the boom 14. The guidance electronics 44 may also be coupled to and receive information from an aiming system for guiding the projectile toward a target. An example is a laser guiding or aiming system, as described below.

The spin rate of the projectile 10 may be on the order of 100 to 500 Hz. However it will be appreciated that other spin rates for the projectile 10 are possible.

The projectile 10 may be any of a variety of devices. To give one example, the projectile 10 may be a munition, such as an artillery shell having a diameter of at least about 50 mm (although use with projectiles of other diameters is possible). A munition may have additional features, such as a warhead or other explosive.

Figure 2:
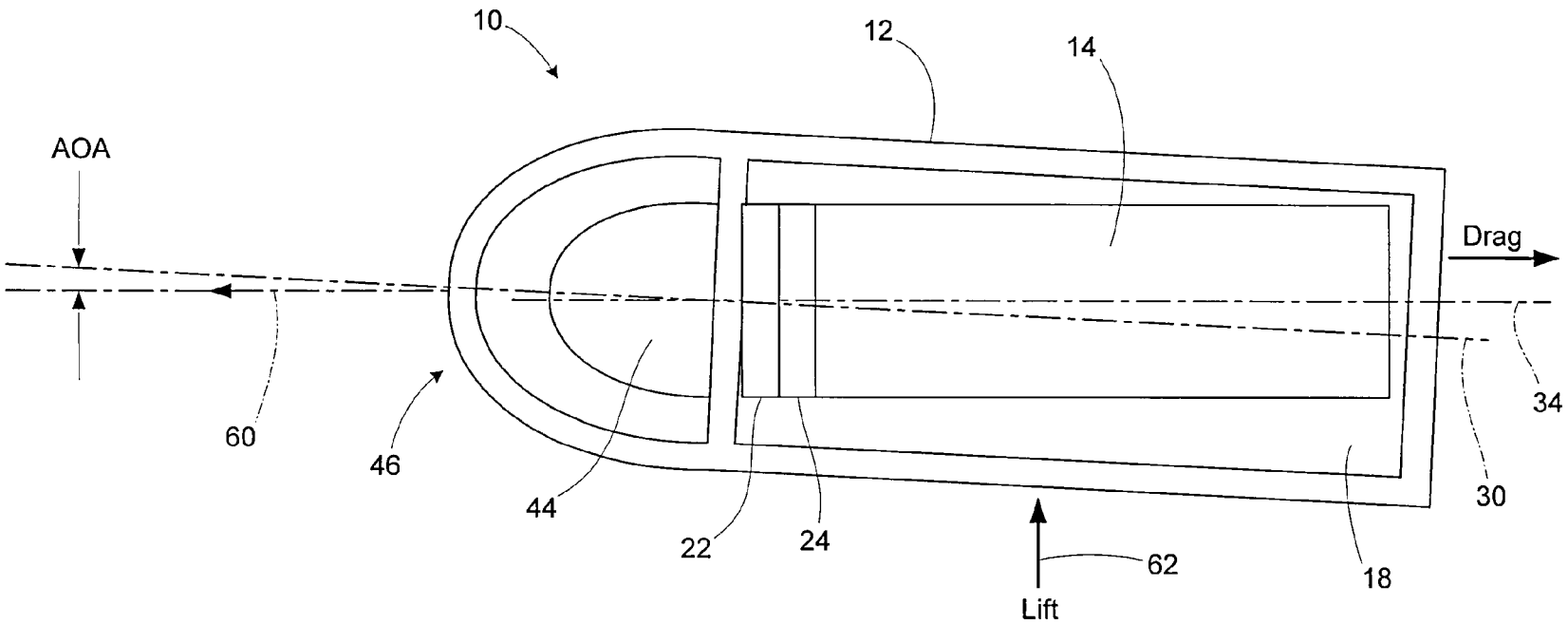
FIG. 2 is a cross-sectional view of the projectile of FIG. 1, with its hull canted upward.

FIG. 2 shows the projectile 10 in flight, with the projectile 10 canted relative to a direction of flight 60. Having the projectile 10 (in particular the hull axis 30 of the projectile hull 12) canted relative to the direction of flight 60 results in uneven aerodynamic forces on the hull 12 of the projectile 10, with the projectile 10 at a non-zero angle of attack relative to the flight direction 60. For example, canting the projectile nose 46 upward as illustrated in FIG. 2 provides lift 62 to the projectile 10. The uneven aerodynamic forces steer the projectile 10, changing the flight direction 60 of the flight projectile. Therefore by properly controlling the angle of the projectile 10 relative to the flight direction 60 the flight path of the projectile 10 may be controlled.

Figure 3:
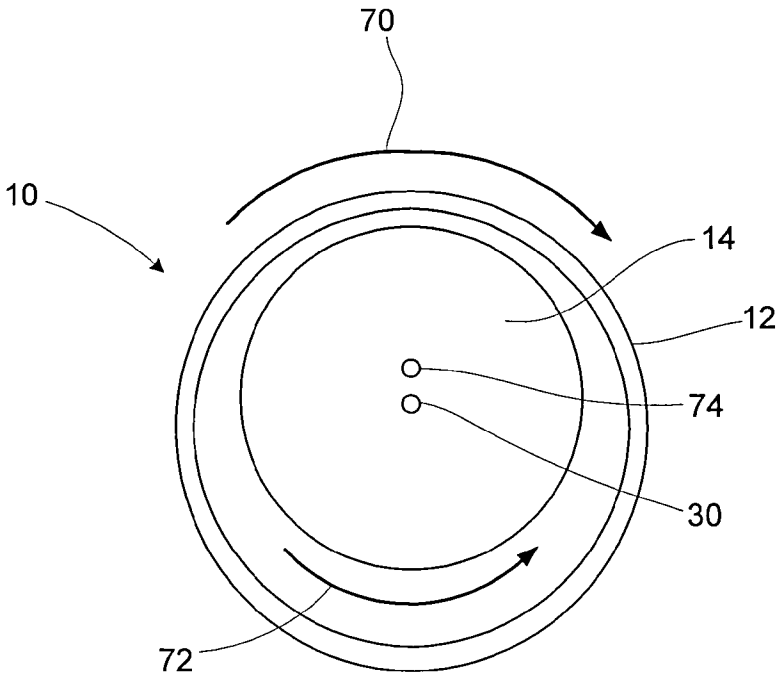
FIG. 3 is an end view of the projectile of FIG. 1.

FIG. 3 illustrates the rotation or spin of the projectile 10, and the tilting of the boom 14 and the counter rotation of the boom 14 relative to the hull 12. The projectile 10 spins or rotates in a first direction 70 (clockwise in the illustration), while the counter rotation of the boom 14 relative to the hull is in the opposite direction 72 (counterclockwise in the illustration). The boom 14 is tilted during the counter rotation such that the principal axis 74 of the boom 14 is offset from the principal axis 30 of the hull 12.

The greater the angle of tilt of the boom 14, the greater the deflection or angle of attack of the hull 12 of the projectile 10. It will be appreciated that the greater the mass of the boom 14, relative to that of the rest of the projectile 10, the greater effect that a given amount of tilt of the boom 14 will have in canting the hull 12.

Figure 4:
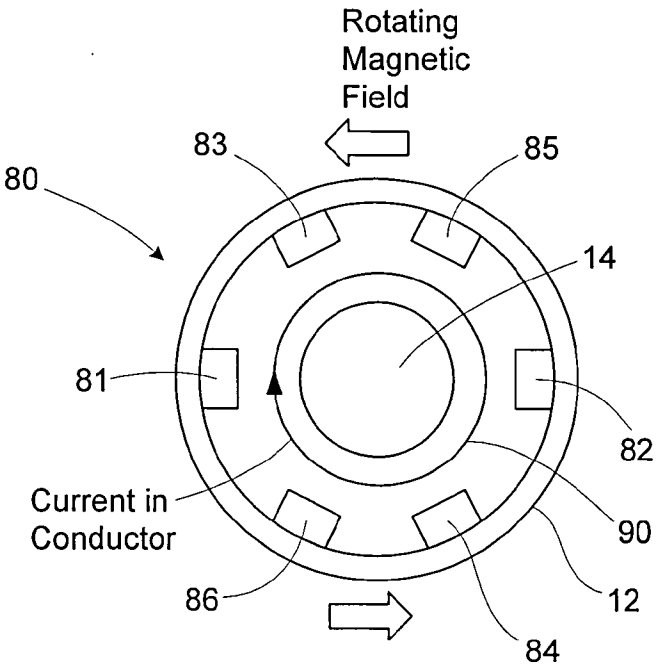
FIG. 4 is an end view showing parts of a magnetic actuator of a projectile in accordance with an embodiment of the invention.
Figure 5:
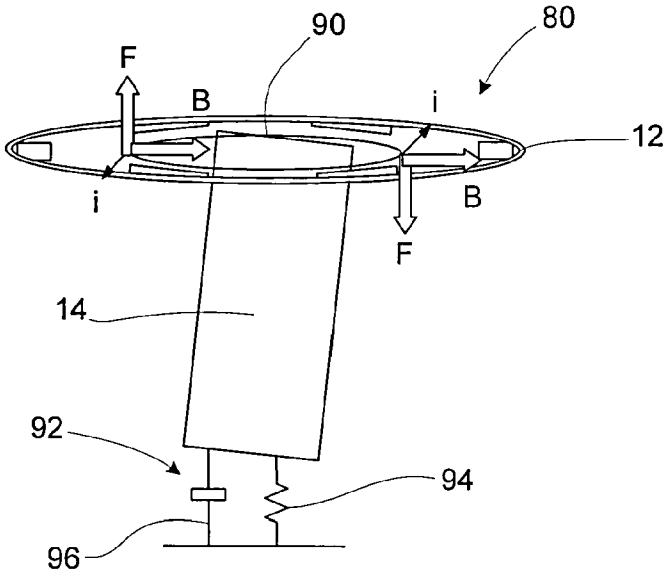
FIG. 5 is an illustration showing operation of the magnetic actuator of FIG. 4.

FIGS. 4 and 5 illustrate one possible actuator configuration for the projectile 10, a magnetic actuator 80. In the actuator 80 shown, the hull 12 has a series of electromagnets 81-86 on its inner surface 88. The electromagnets 81-86 constitute three pairs of diametrically-opposed electromagnets, a first pair of electromagnets 81 and 82, a second pair of electromagnets 83 and 84, and a third pair of electromagnets 85 and 86. The electromagnet pairs act as a three-phase actuator 80 for attracting the boom 14 alternately to different of the electromagnets 81-86 in succession. The boom 14 has a wire loop or other conductor 90 coiled around it. Also, the boom 14 is coupled at a joint 92, for example a U-joint, to the rest of the projectile 10. A spring 94 (or other similar mechanical or other element) provides a centering force, tending to bring the boom 14 toward the central axis 30 (FIG. 1) of the projectile or hull when no force is applied on the boom 14.

As the hull 12 rotates, the electromagnets 81-86 set up a rotating magnetic field around the boom 14. A current is passed through the wire loop or other conductor 90 coiled around the boom 14. By successively applying power to the individual of the electromagnets 81-86, the boom 14 is successively attracted to first one of the magnets 81-86, then to the next magnet, and so on. This tilts the boom 14 off of the centerline axis 30 of the hull 12, pulling all or part of the boom 14 outward against centering force from the spring 94. The sequential attraction of the boom 14 to successive of the electromagnets 81-86 also causes the tilted boom 14 to rotate about the axis 30, relative to the hull 12. By selecting the current (or voltage) applied to the electromagnets 81-86, and how quickly the current (or voltage) is shifted from one electromagnet to the next, both the tilt angle and relative rotation speed of the boom 14 may be controlled. It will be appreciated that the relative rotation speed of the boom 14 (relative to the hull 12) may be set so that the boom 14 does not rotate relative to an environment external to the projectile 10.

Figure 6:
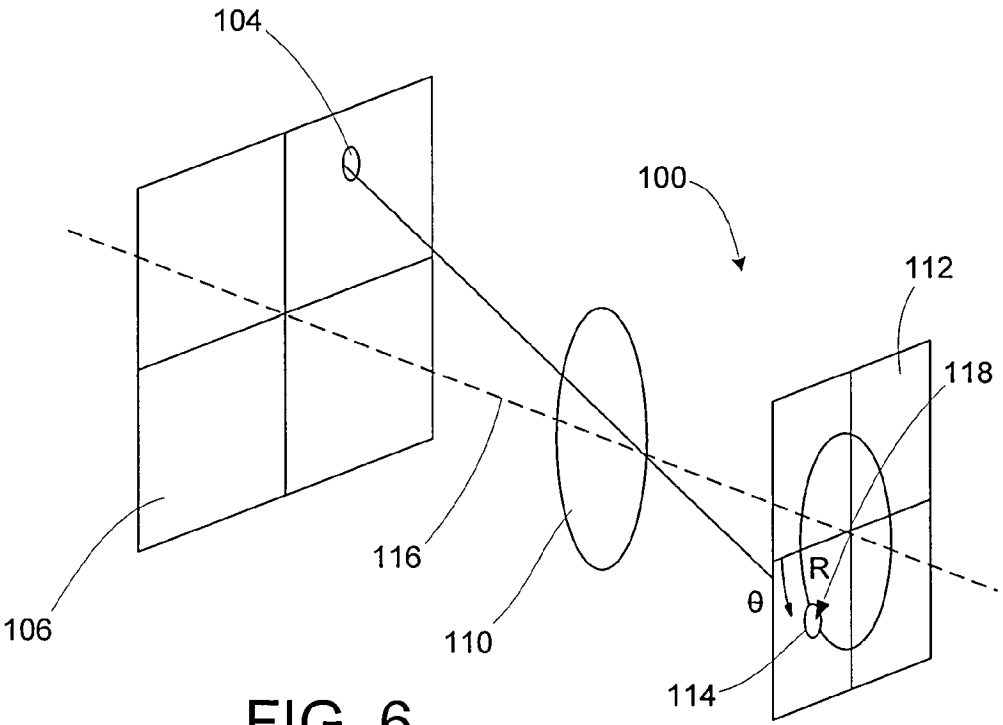
FIG. 6 is an illustration showing parts of a seeker of a projectile in accordance with an embodiment of the invention.

FIG. 6 shows a seeker 100 that may be used as part of the projectile 10 (FIG. 1) to assist in guiding the projectile 10 toward a target. The seeker 100 may be located in the nose 46 (FIG. 1) of the projectile 10. The seeker 100 receives light from a laser target designator 104 shined upon a target or other aim point (destination), represented in FIG. 6 as a target plane 106. The laser that is used to produce the target designator spot 104 may be a part of a launcher for launching the projectile 10, or part of another system. Light from the target designator 104 passes through a lens 110 of the seeker 100, and is received by a photo-detector array (PDA) 112 of the seeker 100. An example of a PDA is a charge-coupled device (CCD). The PDA 112 detects the radius R of the image 114 of the laser target designator 104 from a line of sight 116 of the projectile 10. The PDA 112 also determines an angle θ of the image of the target designator 104, within the plane of the PDA 112 and around a center point 118 of the PDA 112 (for example where the line of the sight 116 intersects the plane of the PDA 112). The determination of the angle θ is used to determine the spin rate of the projectile 10, with of course the change in the angle θ over time corresponding to the spin rate p.

Information from the seeker 100 is used by the guidance electronics 44 (FIG. 1) to control positioning and rotation of the boom 14 (FIG. 1) by appropriately controlling the actuator or actuators of the projectile 10. The information from the seeker 100 may be used to drive a field, such as the field of the magnetic actuator 80 (FIG. 4), at a rate corresponding to the spin rate p of the portion of the projectile 10 that the seeker 100 is connected or attached to. The information from the seeker 100 is used by the guidance electronics 44 to increase the displacement (tilt angle) of the boom 14 as the offset radius R is increased. The boom 14 is also aligned with the target. Once R=0 a line of sight is established that leads the projectile 10 to the target.

It will be appreciated that the seeker 100 is just one of a variety of optical systems that may be used for target tracking for the projectile 10. Other optical or non-optical components may be utilized.

Figure 7:
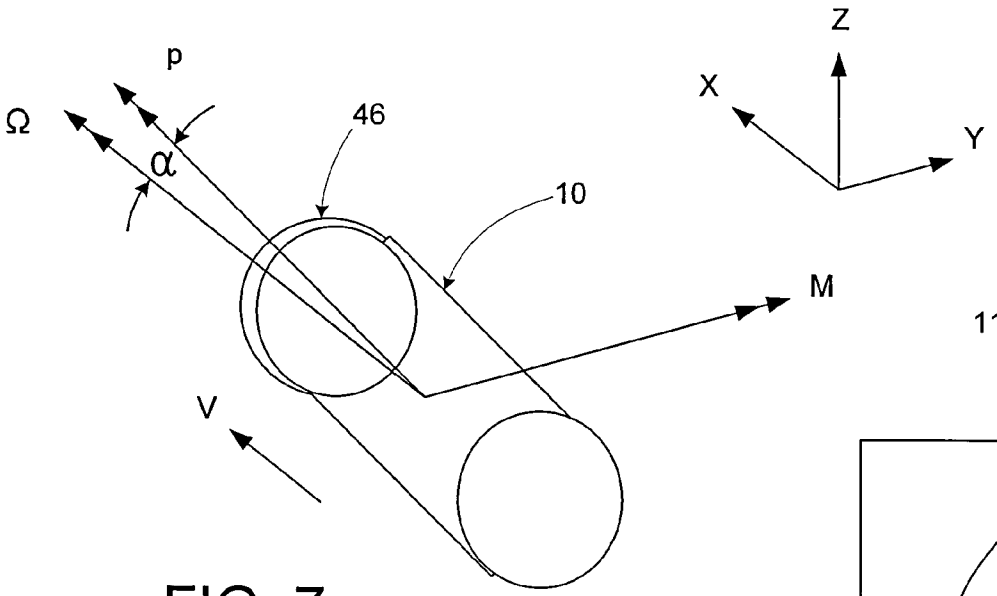
FIG. 7 is a conceptual illustration showing precession of a projectile according to an embodiment of the invention.
Figure 8:
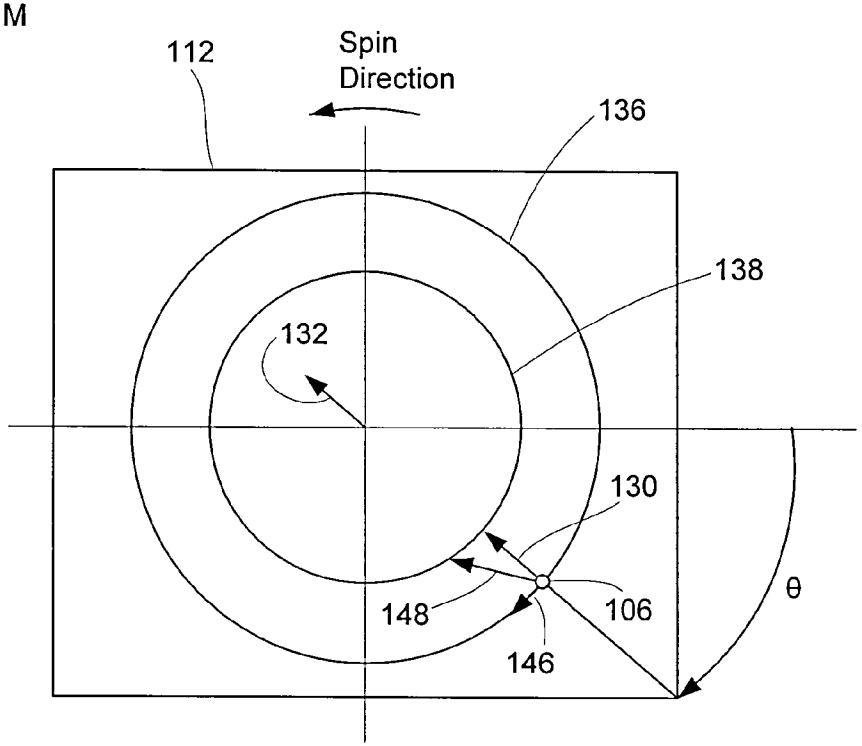
FIG. 8 shows compensation for the precession illustrated in FIG. 7.

FIGS. 7 and 8 illustrate another factor in the guidance and course control of the projectile 10, precession induced by weathervaning drag. With reference to FIG. 7, the projectile 10 is flying in the direction of a vector V, and spinning around the hull axis 30 at rate p. With the projectile 10 pitched nose up about the positive Y axis, weathervaning drag produces a moment M about the Y axis. Precession causes the projectile nose 46 to rotate about the X axis at a rate Ω.

With reference to FIG. 8, compensation for the precession may involve advancing or retarding the rotation of the boom 14 (FIG. 1) to counter the precession. The precession is a pitch-yaw interaction, in that only a pitch of the projectile 10 (FIG. 1) is desired, but a yaw also occurs because of precession. The target image 106 on the PDA 112 suggests a pitch response 130 with a corresponding actuator input 132. The pitch response 130 is selected (neglecting precession effects) to move the projectile trajectory from an initial trajectory 136 to an improved trajectory 138. However the pitch response 130 produces a precession response 146, producing a target response 148 that is the vector sum of the pitch response 130 and the precession response 146. As noted above, advancing or retarding the counter rotation of the boom 14 may be used to counter the precession response 146.

Figure 9:
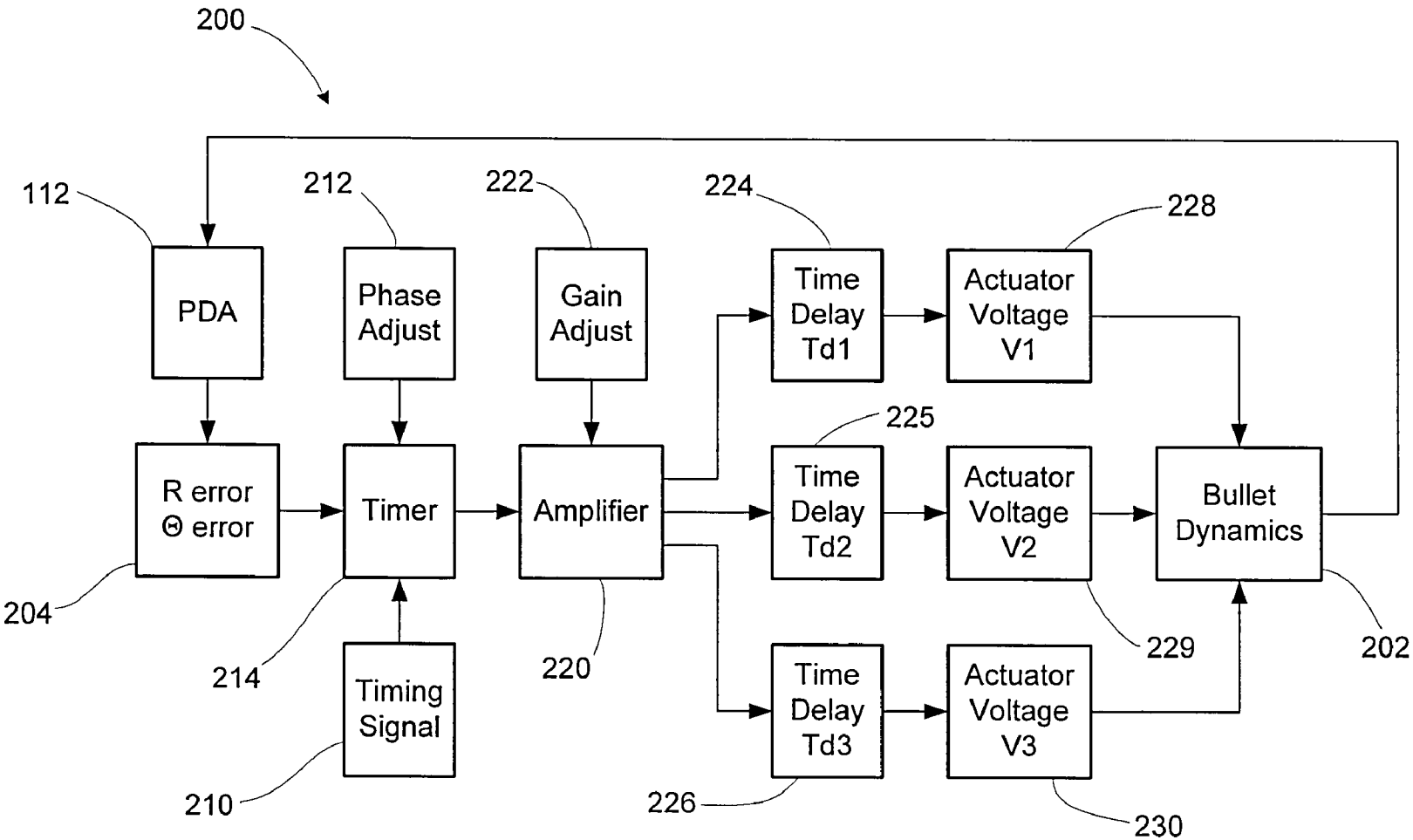
FIG. 9 is a block diagram of a control system for a projectile using the magnetic actuator of FIG. 4.

FIG. 9 shows a control loop 200 used to control the actuator 80 (FIG. 4) to steer the projectile 10 (FIG. 1). Flight of the projectile or bullet 10 produces projectile dynamics 202, which affect the R error and θ value 204 received at the PDA 112. The values of R and θ are used to produce a signal for the magnets 81-86 (FIG. 4) of the actuator 80 (FIG. 4). The R and θ values, along with a timing signal 210 and a phase adjustment 212, are input into a timer 214, used to provide proper timing to the signal. The output from the timer 214 is amplified by an amplifier 220, which has a gain adjustment 222 to determine the amount of amplification necessary. The output signals are sent to the three electromagnet pairs of the actuator 80, providing time delays 224, 225, and 226, to the actuator voltages 228, 229, and 230, provided to the electromagnet pairs 81 and 82, 83 and 84, and 85 and 86, of the phases of the actuator 80.

The projectile and steering method described advantageously has a low cost, does not involve any external control surfaces, and is simple to implement. In addition the steering system described herein is robust, which is an advantage in a high-stress environment such as may occur during launch of a projectile. In addition the control system of the projectile 10 controls the minimum number of degrees of freedom needed to achieve its objective. It controls two degrees of freedom, which is the minimum number necessary to control three dimensional motion. Compared to unguided projectiles, the projectile 10 has increased range and accuracy, and enables better engagement of moving targets. Further it is compatible with current weapons systems, requiring no special modifications. The optically-guided line-of-sight control system costs less then current guided systems, which is an advantage especially in view of the destruction of the projectile 10 at the end of its flight.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A spin-stabilized projectile comprising:

an external body;

an internal mass in a cavity of the body, wherein the internal mass is mechanically coupled to the body such that the internal mass is selectively movable toward and away from an axis of the body and rotated about the axis relative to the body; and a single, unified actuator operatively coupled to the internal mass both to selectively move the internal mass toward and away from the axis, and to rotate the internal mass about the axis relative to the body.

2. The projectile of claim 1, wherein the internal mass contains a battery.

3. The projectile of claim 1, wherein the internal mass contains lead.

4. The projectile of claim 1, wherein the internal mass constitutes 20% to 55% of the weight of the projectile.

5. The projectile of claim 1, wherein the internal mass constitutes 49% to 51% of the weight of the projectile.

6. The projectile of claim 1, wherein the internal mass is tiltable relative to the body.

7. The projectile of claim 1, wherein the internal mass is a cylindrical boom coupled to a nose of the body.

8. The projectile of claim 1, wherein the actuator is a magnetic actuator that uses magnetic forces to position the internal mass relative to the body.

9. The projectile of claim 8, wherein the magnetic actuator includes pairs of diametrically-opposed electromagnets attached to an inner surface of the body; and wherein voltage may be successively applied to the pairs of electromagnets to move the at least part of the internal mass away from the body axis, and to rotate the internal mass about the body axis, relative to the body.

10. The projectile of claim 1, further comprising control electronics operatively coupled to the actuator to control movement of the internal mass by the actuator.

11. The projectile of claim 10, further comprising a seeker operatively coupled to the control electronics; and wherein the seeker provides information to the control electronics regarding location of a target relative to the projectile.

12. The projectile of claim 11, wherein the seeker includes a photo-detector array (PDA) that detects a location of an image of a target designator.

13. A method of controlling flight of a projectile, the method comprising:

rotating in a first direction a body of the projectile about a longitudinal axis of the projectile; and counter-rotating an internal mass of the projectile about the longitudinal axis in a second direction, opposite the first direction, relative to the body of the projectile;

wherein the internal mass is within a cavity in the body; and wherein the counter-rotating includes counter-rotating the internal mass relative to the external body so as to keep the internal mass in substantially the same orientation relative an environment external to the projectile, for steering the projectile in a given direction.

14. The method of claim 13, further comprising steering the projectile by moving the internal mass within the cavity, to thereby place the projectile at a nonzero angle of attack relative to a flight direction of the projectile.

15. The method of claim 14, wherein the moving includes tilting the internal mass relative to the body, within the cavity.

16. The method of claim 15, wherein the tilting and the counter-rotating are accomplished by a magnetic actuator of the projectile, using magnetic forces to tilt and counter-rotate the internal mass.

17. The method of claim 16, wherein the steering includes selecting a direction of movement of the internal mass and a rate of counter-rotation based on information received by a seeker of the projectile.

18. The method of claim 14, wherein the tilting is a function a vector sum of a pitch response to a target image received by the seeker, and precession response produce by the pitch response.

19. The method of claim 14, wherein the moving includes moving the internal mass toward or away from a longitudinal axis of the body.

* * * * *